United States Patent [19]

Osteen

[11] Patent Number: 4,503,657

[45] Date of Patent: Mar. 12, 1985

[54] CARRIER APPLICATOR

[75] Inventor: John F. Osteen, Lynchburg, Va.

[73] Assignee: Dacam Corporation, Madison Heights, Va.

[21] Appl. No.: 363,267

[22] Filed: Mar. 29, 1982

[51] Int. Cl.[3] ..... B65B 17/02; B65B 21/00

[52] U.S. Cl. ..... 53/48

[58] Field of Search ..... 53/48, 314, 315, 313, 53/367

[56] References Cited

U.S. PATENT DOCUMENTS

| | | | |
|---|---|---|---|
| 3,336,723 | 8/1967 | Shazor, Jr. | 53/48 X |
| 3,680,279 | 8/1972 | Picq | 53/48 X |
| 3,859,773 | 1/1975 | Calvert et al. | 53/48 |
| 4,132,052 | 1/1979 | Larson | 53/367 X |
| 4,231,209 | 11/1980 | Walker et al. | 53/48 |
| 4,392,586 | 7/1983 | Hartness et al. | 53/48 X |

*Primary Examiner*—Horace M. Culver

[57] ABSTRACT

A reciprocating platen automatically aligns and seats the carriers. Extending downwardly from the surface of the platen is a pair of spaced, conically shaped projections. As the platen is lowered, the inclined surface of each projection engages and cooperates with the edge of one of the circular finger-grip openings in the upper surface of the carrier. The carrier moves in a plane parallel to the platen surface until the base of each projection is received within a different one of the openings, thereby correcting any misalignment. Further movement of the platen causes the platen surface to exert a downward force on the carrier. This results in the container engaging openings being received over the closures of the respective containers. The platen is provided with recesses, each aligned with a different container engaging opening. The closures are received in the respective recesses to permit the platen to move to an extreme downward position.

17 Claims, 8 Drawing Figures

CARRIER APPLICATOR

The present invention relates to a carrier applicator and, more particularly, to a carrier applicator including a platen which both automatically aligns and reliably seats the carrier on a set of containers, in a single operation.

Liquid containers, such as glass or plastic bottles and jars, in which carbonated beverages, juices, fruit drinks and the like are packaged, are often sold in multiples as a unit containing six or eight containers each. In order to maintain the containers as a unit, as well as to provide a convenient way to handle the containers, a carrier is often provided for the containers. The carriers have, in the past, commonly been formed of a paper product such as cardboard but, more recently, carriers composed of molded or extruded plastic materials have been utilized becuase plastic carriers are inexpensive as well as being high in strength and low in weight.

The structure of various types of plastic carriers designed to accommodate multiple containers are known in the art. Such carriers commonly consist of a thermally formed plastic receptacle designed to engage the upper portion of each of the containers. Each container is engaged by and suspended from an opening in the top of the carrier in a "snap-fit" fashion by seating flexible engaging means below the annular protrusion or flange on the neck of the container.

In some types of containers, the annular protrusion or flange is positioned on the neck of the container, immediately below the area upon which the container closure is situated. In other types of containers, the closure extends over the annular projection or flange and has an inwardly directed sealing portion which covers the bottom of the annular projection or flange and is designed to be broken away when the closure is twisted off the container. In either case, the container is provided with an annular projection or flange, which may or may not be covered by the closure, but which always has a diameter greater than the section of the neck of the container immediately below same.

Each container engaging opening in the carrier is provided with container engaging means. These container engaging means are flexible and are designed to permit the annular projection or flange on the neck of the container to pass therethrough. The carrier is applied to the containers by pushing same downwardly such that the container closures extend above the respective openings. The container engaging means are then seated adjacent the neck of the container, below the annular projection or flange, so as to securely engage the container and prevent accidental dislodgement from the carrier.

One well known carrier of this sort is the International Omni Pak carrier. This carrier has an upper surface with a solid plastic central body portion, extending along the length thereof, approximately one inch in width. The body portion has therein a pair of spaced circular finger-grip openings which facilitate grasping of the carrier by the thumb and forefinger. Extending laterally from, and distributed along each side of, the body portion are three pairs of spaced, elongated plastic rails. The ends of each pair of plastic rails are connected by a semi-circular rail so as to define an area within which the container engaging means is mounted. Additional plastic rails, extending parallel to the body portion, but spaced therefrom, are provided between the laterally extending rail pairs to enhance the structural rigidity of the carrier. The lower portion of the carrier is a continuous horizontal plastic rail which defines a generally rectangular area with curved corners at a level below the top surface. The bottom rail is connected to the top surface by a plurality of spaced, substantially vertically extending rails.

Each container engaging means includes a pair of juxtaposed, oppositely oriented concave parts, each having an upwardly and inwardly inclined bottom surface. The parts are cammed apart as the container neck is inserted therebetween and, thereafter, return to their original relative position, seated below the annular projection or flange of the container, such that the container is reliably held to the carrier.

Such carriers may be designed for use with six or eight containers. The carriers are provided with a number of container engaging means equal to the number of containers to be carried.

To be commercially successful, the carrier applicator must be fully automated and capable of high speed operation. Each container must be properly seated with respect to the carrier. In addition, these functions must be performed in a way which minimizes the possibility of damage to the carrier, to the container and to the container closures.

Two main functional problems have arisen in high-speed automated applicators designed for use with plastic carriers. The first relates to the difficulty of correctly aligning the carriers with the set of containers. If the carrier is not accurately aligned with the containers, and particularly the container engaging means with the container closures, the forces exerted on the carrier to seat same will cause breakage of the carrier or the closures, or both. This requires that the applicator be temporarily shut down, the broken carrier and/or containers removed, and the machine restarted.

The second problem relates to the inadequate seating of one or more of the container engaging means. If each container engaging means is not properly seated, the container will not be held reliably by the carrier and can be accidentally dislodged therefrom during shipping and handling.

It is, therefore, a prime object of the present invention to provide a carrier applicator designed for fully automatic, high-speed operation.

It is another object of the present invention to provide a carrier applicator wherein the carriers are automatically properly aligned with respect to the containers during the application operation.

It is another object of the present invention to provide a carrier applicator wherein proper seating of every container is reliably insured.

It is another object of the present invention to provide a carrier applicator wherein damage to the carriers during application is minimized.

It is another object of the present invention to provide a carrier applicator wherein damage to the container closures during application is minimized.

It is another object of the present invention to provide a carrier applicator which is capable of applying multiple carriers simultaneously.

It is another object of the present invention to provide a carrier applicator which is composed of relatively simple, inexpensive parts which cooperate together reliably and which will function over an extended useful life with minimum maintenance.

In accordance with the present invention, apparatus is provided for applying a carrier to a set of containers. The carrier is of the type having a surface with first and second spaced circular finger-grip openings of a given diameter. The carrier also has means for engaging the containers. The apparatus comprises a platen, means for supporting a set of containers with a carrier situated thereon and means for moving the platen towards the support means. The platen comprises means for engaging and cooperating with each of the finger-grip openings to align the carrier relative to the platen. Means are also provided for exerting a force on the carrier surface, in the direction of the support means, to cause the containers to be received in the respective container engaging means. In addition, means are provided in the platen for receiving portions of the containers which extend above the container engaging means.

The carrier alignment means comprises first and second spaced projections extending from the platen in the direction of the support means. The projections are positioned along the platen at the desired positions of the respective finger-grip openings.

Each projection has a base having a diameter substantially equal to the given diameter and a tip having a diameter substantially smaller than the given diameter. Extending between the base and the tip is an intermediate section having an inclined surface.

The inclined surface of the intermediate section engages the edge of the aligned finger-grip opening as the platen is moved towards the support means. As this occurs, the carrier is moved relative to the platen in a planar, substantially parallel direction thereto until the base is received in the finger-grip opening.

The force exerting means comprises the surface of the platen from which the projections extend. As the platen is moved downwardly toward the support, this surface contacts the upper surface of the carrier and exerts a downwardly directed force thereon to move same towards the support, seating the carrier.

The receiving means comprises a plurality of recesses in the platen, each of which is aligned with a different one of the container engaging means. These recesses serve to receive each of the closures of the containers as same are caused to extend above the carrier surface by the seating of the carrier. The recesses insure that the closures will not interfere with the downward movement of the platen. Thus, the platen can move to an extreme downward position, to insure seating of each of the container engaging means. These recesses are larger than the container engaging means such that the container closures can be accommodated with sufficient clearance to prevent any damage thereto.

To these and to such other objects as may hereinafter appear, the present invention relates to a carrier applicator, as described in detail in the following specification and recited in the annexed claims, taken together with the accompanying drawings, wherein like numerals refer to like parts and in which:

Figure 1:
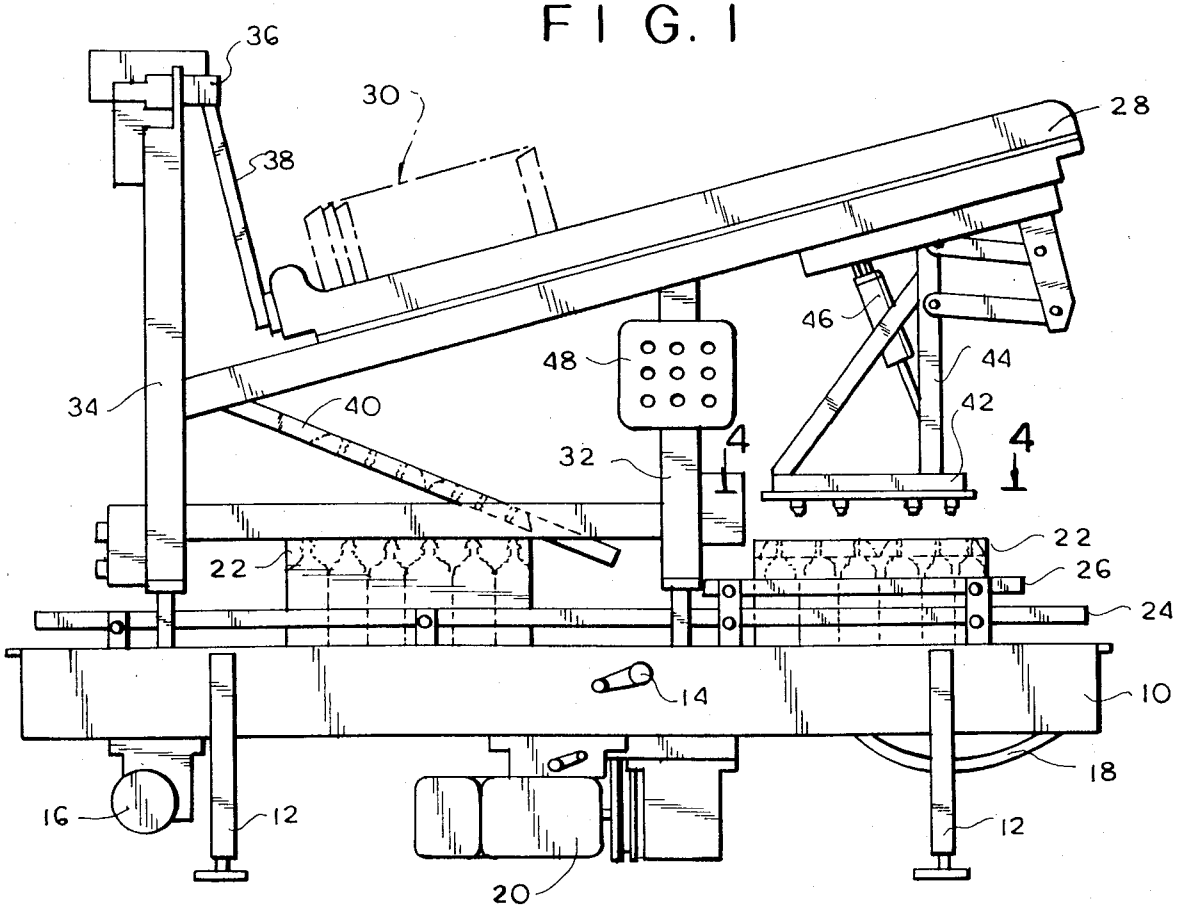
FIG. 1 is a side elevation view of the carrier applicator of the present invention.
Figure 2:
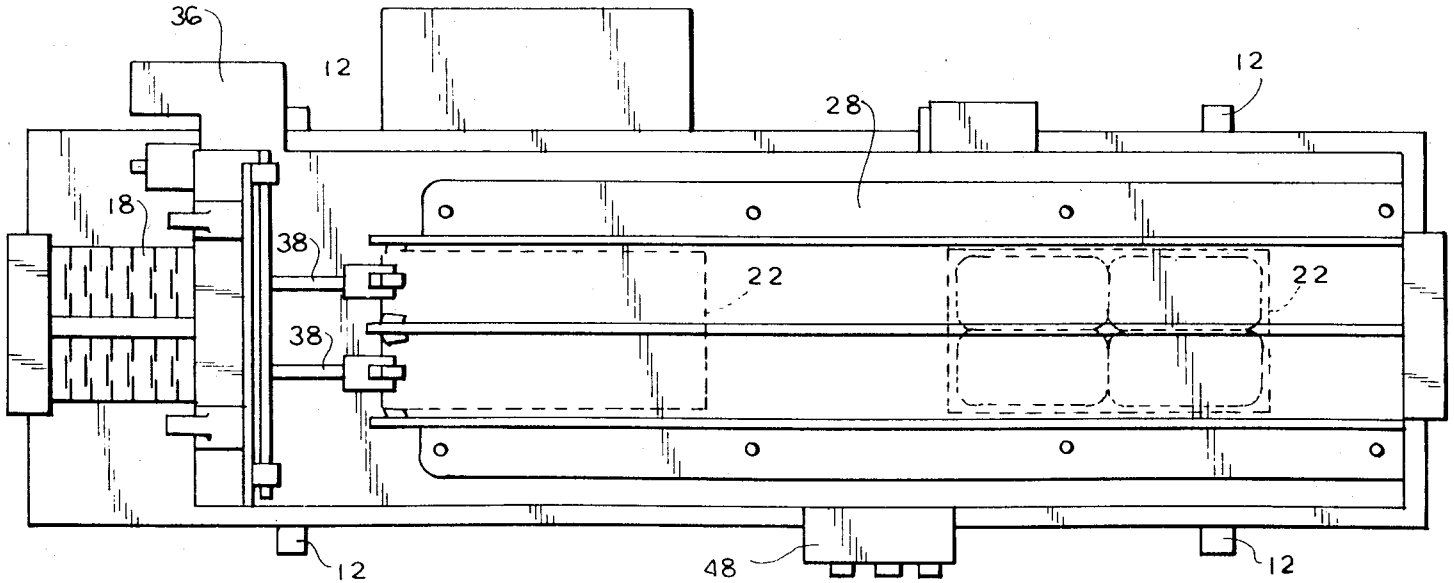
FIG. 2 is a top elevation view of the carrier applicator of the present invention.
Figure 3:
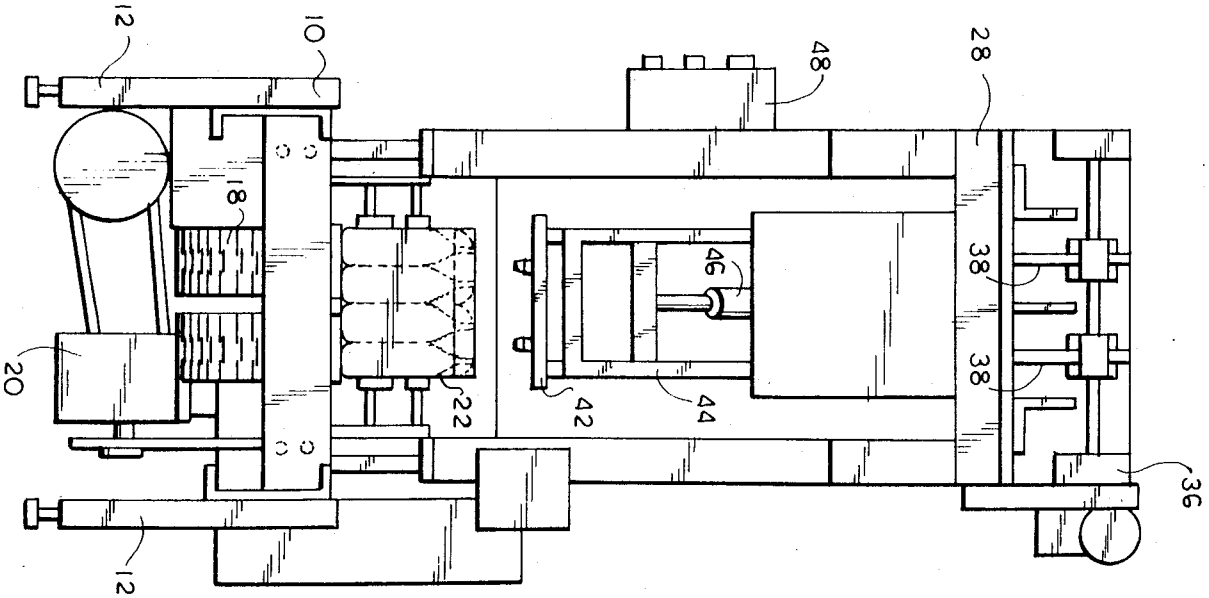
FIG. 3 is a front elevation view of the carrier applicator of the present invention.

As best seen in FIGS. 1, 2 and 3, the lower section of the carrier applicator of the present invention includes a table-like base 10, supported by four vertical legs 12. The effective length of each leg 12 can be manually adjusted, in a conventional fashion, by the rotation of handle 14. An optional leg length adjustment motor 16 may also be provided. The adjustment of the effective length of legs 14 serves to raise or lower base 10 with respect to the floor upon which the apparatus rests.

The input end of the carrier applicator is normally situated adjacent the output end of a case packer or other apparatus which supplies a flow of cases having containers therein. Accordingly, the height of the case conveyor 18 is made adjustable to accommodate the heights of different case packers.

Within base 10 is provided endless belt-type case conveyor 18, powered by an electric motor 20. Conveyor 18 serves to transport cases 22, within which are situated sets of containers, from the input end (left, as seen in the drawings), to the output end (right, as seen in the drawing) of the carrier applicator.

Case conveyor 18 is provided with guide rails 24, 26, designed to maintain the proper lateral position of cases 22 with respect to conveyor 18, as the cases 22 are moved along the apparatus. Guide rails 24 and 26 extend above the surface of conveyor 18 on either side thereof.

Situated above case conveyor 18 is a hopper 28 upon which two side-by-side stacks of upstanding plastic carriers 30 are placed. Hopper 28 is positioned at an incline with respect to the horizontal to provide a gravity feed and is supported by vertical supports 32 and 34. Hopper 28 preferably has the capacity of 600 carriers which will last approximately five minutes when the carrier applicator is operated at a speed of 30 cases per minute.

Mounted on top of vertical supports 34 is a carrier dispensing mechanism 36 which includes a pair of pivotal dispensing arms 38, one of which is aligned with each of the stacks on hopper 28. As arms 38 are pivoted, carriers from the aligned stack on hopper 28 are permitted to drop, with the upper surface thereof facing upwardly, onto the aligned channels in a dual channel carrier depositing guide structure 40. As a case 22 is moved beneath guide 40 by conveyor 18, the first and second side-by-side pairs of carriers are deposited, in sequence, onto the first and second side-by-side sets of containers in case 22.

As illustrated in the drawings, each case 22 contains twenty-four contaners, shown here as bottles, such that four carriers will be deposited on each case, thereby forming four six-packs per case. The movement of case 22 along conveyor 18 is synchronized with the release of the carriers from carrier guide 40, such that each carrier will be deposited on the tops of the closures of six bottles to which it will be applied.

After carriers 30 have been deposited on the containers within case 22, case conveyor 18 conveys case 22 toward the output end of the apparatus until case 22 is at a point on the apparatus above the rear legs 12. Once in this position, the motion of the case is temporarily terminated. Above this point on the conveyor 18 is a platen 42 having a structure described in detail below.

Platen 42 is supported from above by mechanical linkage 44 which, in turn, is suspended from the underside of hopper 28. Linkage 44 is a well known parallelogram-type linkage which permits platen 42 to be reciprocated vertically while maintaining a substantially horizontal position with respect to the surface of conveyor 18. Linkage 44 is driven by a pneumatic cylinder 46 connected between linkage 44 and the undersurface of hopper 28.

When case 22 is in the correct position with respect to platen 42, the movement of the case is momentarily stopped by the inertia of a lever arm (not shown) which intersects the path of the case and interferes with movement thereof as it is cammed out of the way of the case. During the momentary stoppage of the movement of the case, the presence of the case at the correct position relative to platen 42 is sensed (by any type of conventional sensor) and pneumatic cylinder 46 is actuated to move platen 42 towards the surface of conveyor 18. This movement, in general, causes platen 42 to correctly align each of the four carriers 30 in case 22 and, thereafter, to apply a downwardly directed force thereon so as to seat the carriers simultaneously on the four sets of containers in the case.

After the downward stroke of platen 42 is completed, cylinder 46 automatically reverses direction, causing platen 42 to move upwardly, thereby withdrawing it from the case. Once the platen has cleared case 22, the case is accelerated up to the normal speed again by conveyor 18 so as to move the case, now containing the container sets with the carriers seated thereon, to the output end of the apparatus to permit removal of same. At the same time, the next case 22, in succession, is moved into position in alignment with platen 42 and the carrier applying cycle is repeated.

In this manner, carriers are applied, four at a time, to four sets of containers in each case, in a high speed automated operation. The operator is provided with a set of controls on control box 48, such that the operation of the apparatus can be conveniently controlled.

Figure 4:
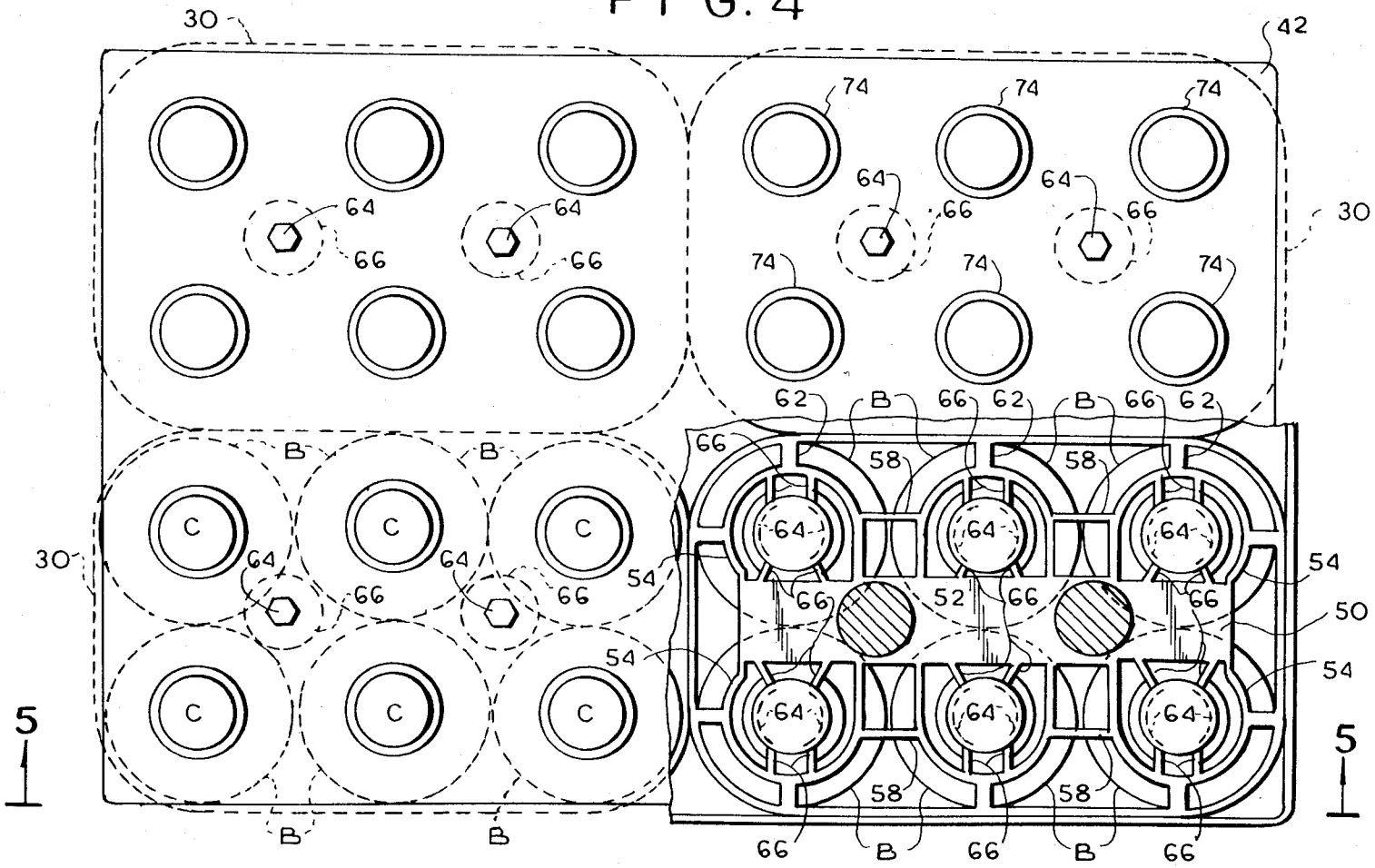
FIG. 4 is a top, partial cut-away view of the platen of the carrier applicator of the present invention, taken along line 4—4 of FIG. 1.

Platen 42 is illustrated in FIG. 4. Platen 42 has a substantially planar lower surface which can be conceptually divided into four quadrants. Each quadrant will cooperate with a different one of the four carriers in the case to align and seat same. Each of the quadrants has an identical structure and will function in an identical manner.

Each carrier 30 is applied to a set of containers, illustrated as bottles B. In the drawings, each set of bottles B is shown as including six bottles arranged in a two-by-three array. However, it is to be understood that, with slight modifications, well within the skill of the ordinary artisan, sets of bottles B containing eight bottles arranged in a two-by-four array can be easily accommodated. Each bottle B has a closure C on the top thereof.

The structure of the carrier 30 is best illustrated in FIGS. 4 through 8. Carrier 30 comprises an upper surface with a solid plastic central body portion 50, approximately one inch in width. Body portion 50 has therein a pair of spaced circular finger-grip openings 52 which facilitate grasping of the carrier by the thumb and forefinger of the user. Extending laterally from and distributed along each side of body portion 50 are three pairs of spaced elongated plastic rails 54. Each pair of plastic rails 54 is connected by a curved rail 56, defining an area within which the container engaging means is mounted. Additional plastic rails 58, extending parallel to body portion 50, but spaced therefrom, are provided between the laterally extending rail pairs 54 to enhance the structural rigidity of the rail pairs.

The lower portion of carrier 30 is a continuous horizontal plastic rail 60, in a generally rectangular configuration, with rounded corners. Rail 60 is situated substantially below top surface 50. Bottom rail 60 is connected to the top surface and, more particularly, to rails 56 thereof, by a plurality of spaced substantially vertically extending rails 62.

Each container engaging mens includes a pair of juxtaposed oppositely oriented concave parts 64. Each part 64 has an upwardly and inwardly inclined bottom surface. The upward and inward incline of the bottom surfaces of parts 64 permit the parts to be cammed apart as the container closure C is inserted therebetween. Parts 64 are supported by rails 66 which flexibly mount same to rails 56 and surface 50. Rails 66 tend to retain parts 64 in their original positions. Thus, after parts 64 have been cammed apart by the insertion of closures C therebetween, rails 66 tend to cause parts 64 to move back toward each other, to a position adjacent the neck of the container, below the annular projection or flange thereon, so as to securely engage the container and prevent accidental dislodgement from the carrier.

Each quadrant of platen 42 is provided with a pair of spaced holes or bores into which the upwardly extending shafts 64 of downwardly extending projections 66 are received. The openings or bores, and thus shafts 64, are aligned with the desired position of the center of the finger-grip openings 52 on carrier 30.

Each downwardly extending projection 66, as is best seen in FIGS. 5 through 8, has a three-part structure including a base 68, a tip 70, and an intermediate portion 72. Base portion 68 of projection 66 comprises a disc-like structure, the circular side of which is substantially perpendicular to the lower surface of platen 42. The thickness of base portion 68 is approximately equal to the thickness of body portion 50 of carrier 30. Base 68 has an outer diameter approximately equal to the inner diameter of finger-grip opening 52, such that base portion 68 can be snuggly received within finger-grip opening 52.

Tip 70 of projection 66 is substantially conically shaped with a flat or blunt nose. The intermediate portion 72 of the projection is also a conical section with an inclined side. The smaller lower face of intermediate section 72 has a diameter approximately equal to the widest portion of tip 70, whereas the upper larger face of intermediate portion 72 has a diameter approximately equal to the diameter of base portion 68. The inclination of the surface of intermediate section 72 is somewhat greater than the inclination of the side of tip 70.

Figure 5:
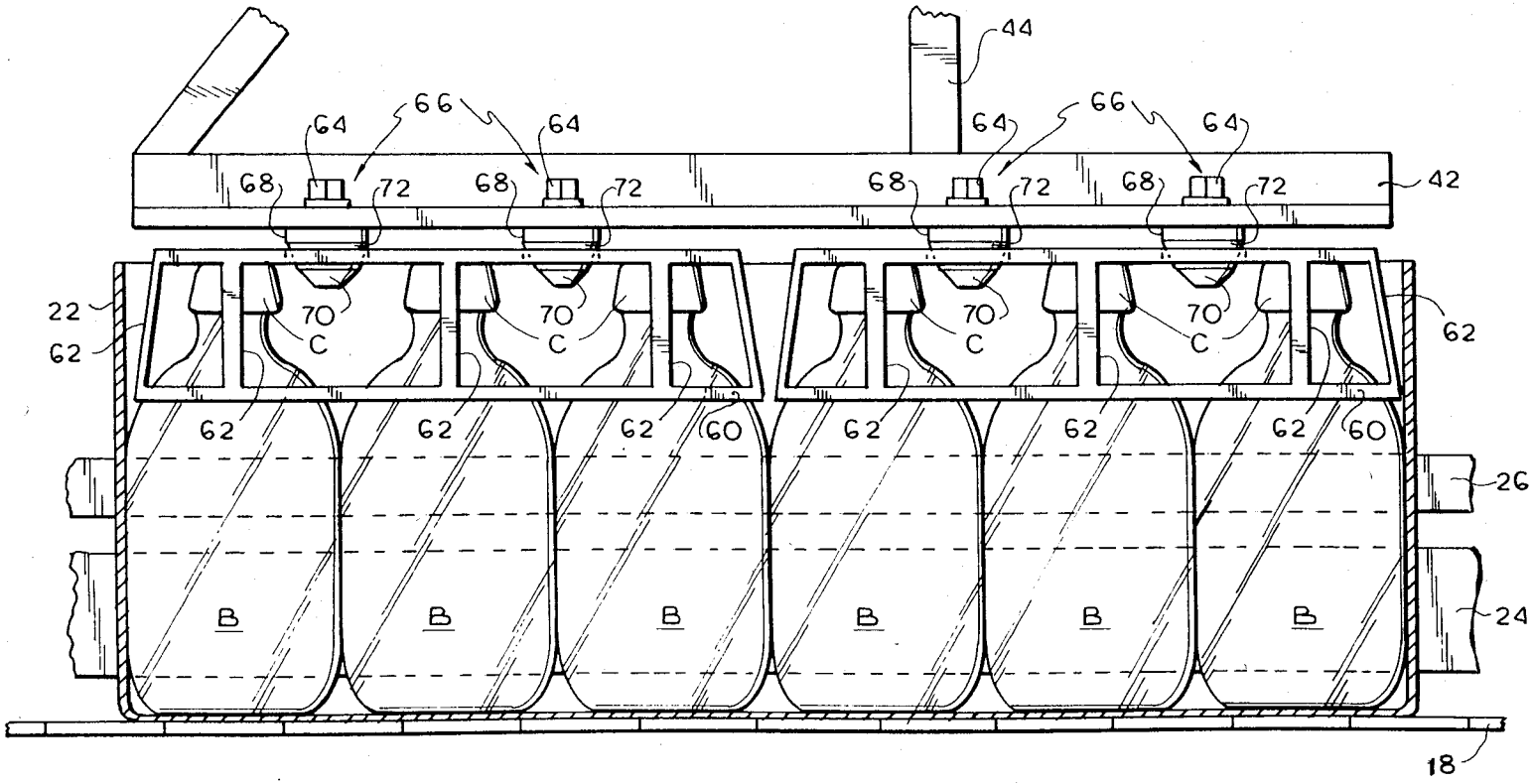
FIG. 5 is a side elevation view of a portion of the carrier applicator of the present invention showing the details of the platen and the position thereof as the projections engage the finger-grip openings of the carrier.
Figure 6:
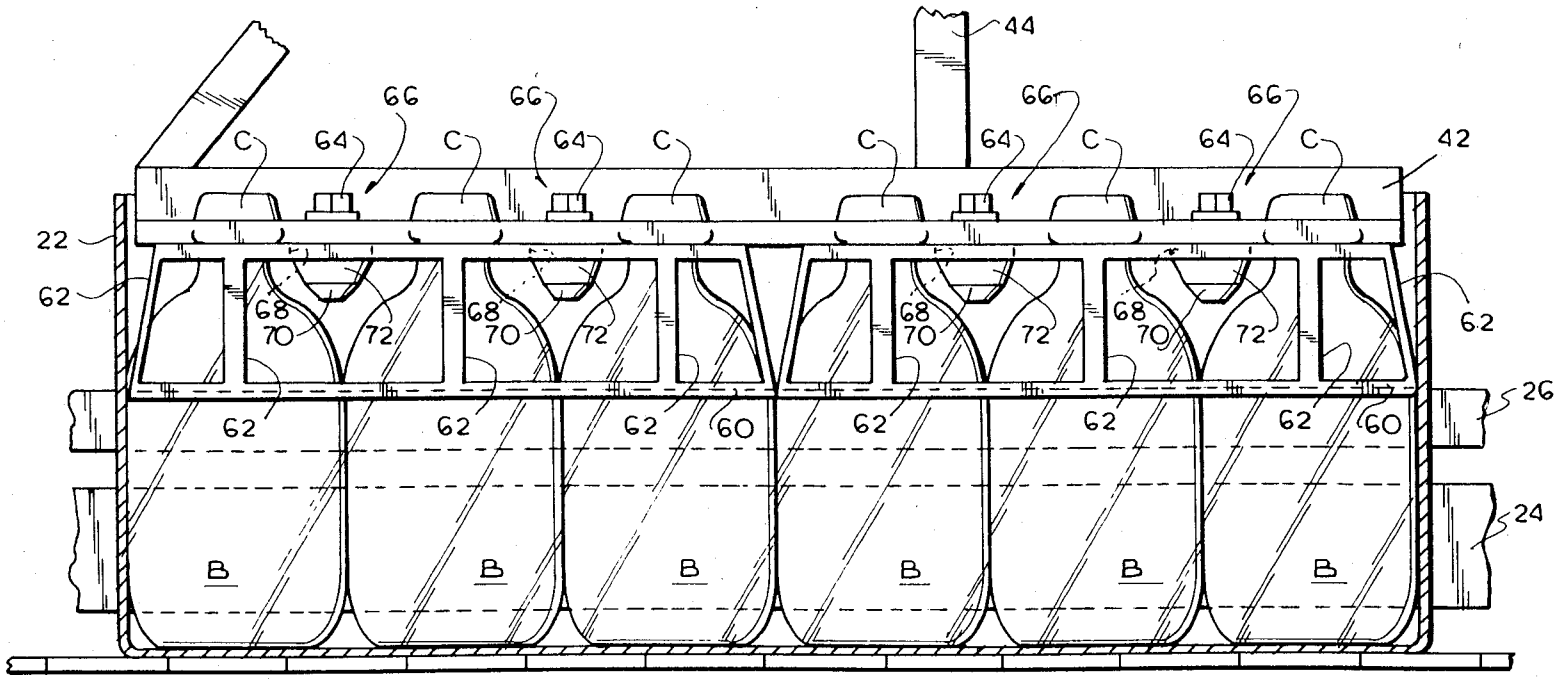
FIG. 6 is a side elevation view of the portion of the carrier applicator of the present invention illustrated in FIG. 5, showing the platen at the end of its downward movement.
Figure 7:
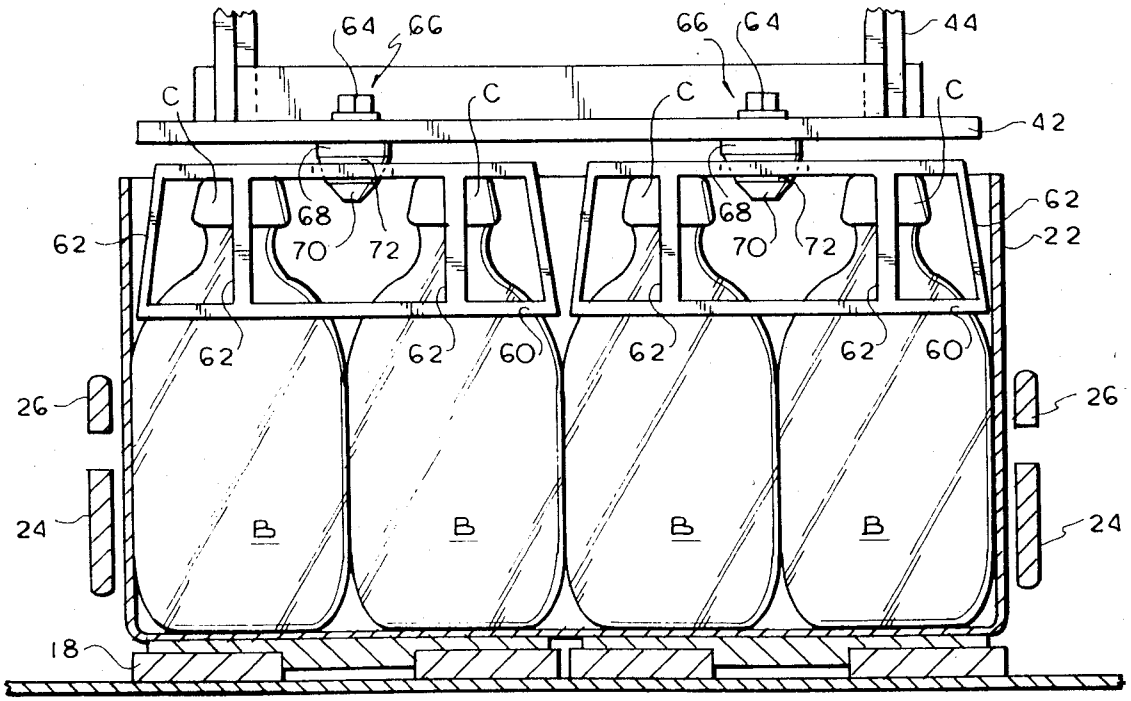
FIG. 7 is a front elevation view of the portion of the carrier applicator of the present invention illustrated in FIG. 5.
Figure 8:
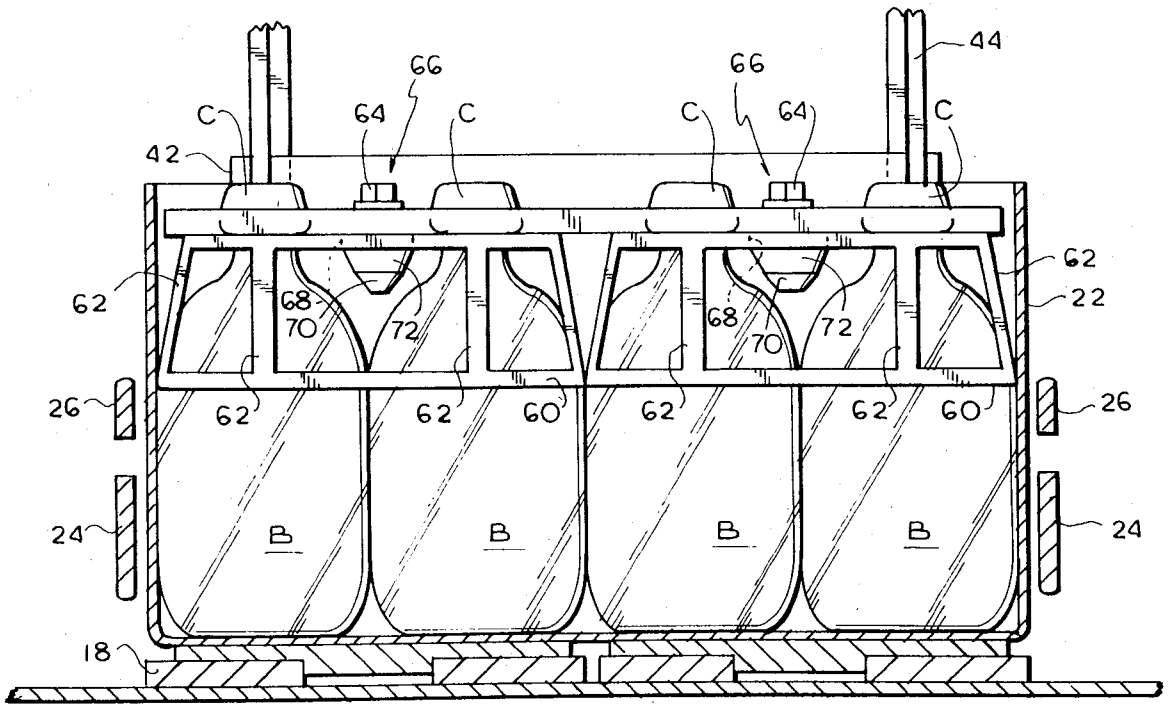
FIG. 8 is a front elevation view of the portion of the carrier applicator of the present invention illustrated in FIG. 6.

Projections 66, for each quadrant of platen 42, define the desired position of the carrier with respect to that quadrant and serve to move the carrier, in a plane substantially perpendicular to the plane of the platen, to the desired carrier position, should the carrier be misaligned with respect to the sets of bottles to which it is to be applied. The manner in which this is accomplished is best understood with reference to FIGS. 5 through 8. FIGS. 5 and 7 show side and front views, respectively, of the platen as it is moved downwardly towards conveyor 18. FIGS. 6 and 8 show side and front views, respectively, of the platen as it reaches the end of its downward path.

As platen 42 is moved downwardly, towards conveyor 18, the tip section 70 of the projections 66 will be received within the respective finger-grip openings 52 on the carrier, even if the carrier is misaligned with respect to the bottles. If the carrier is grossly misaligned, the inclined surface of tip 70 will serve to correct a portion of this misalignment so that the intermediate section 72 will align with the openings. As the platen continues to move, one or both of finger-grip openings 52 will engage the inclined surface of the respective intermediate portions 72. When this occurs, further downward movement of the platen will cause the inclined surface of the projections to cooperate with the edges of the openings to move the carrier in a plane substantially parallel to the lower surface of the platen, until the edge of the finger-grip openings reach the boundary between intermediate portion 72 and base portion 68 of the respective projections. At this point, further downward movement of the platen will cause base portion 68 to be received within the finger-grip opening aligned therewith. At this point, each of the finger-grip openings is in its desired position with respect to the platen and the carrier is properly aligned with the platen and the bottles to which the carrier is to be applied.

The lower surface of the platen will then contact the upper surface of central body portion 50 as well as the upper surfaces of the rails 54, 56, 58 and the container engaging means including part 64 and the supports 66 therefor. After contact is made, further downward movement of the platen causes the carrier to move downwardly such that the outwardly inclined side surface of the enclosures C cause the container engaging parts 64 of each container engaging means to move outwardly and cam around the annular projection or flange on the bottle neck. As the platen reaches the end of its downward path, parts 64 pass below the annular projections covered by closures C and will snap inwardly back towards the neck of the bottle, such that same are seated below the closure and the annular projection or flange which is covered thereby. At this point, the relative position of the platen, carrier and bottles appears as shown in FIGS. 6 and 8.

From FIGS. 6 and 8, it can be readily appreciated that closures C on bottles B extend above the upper surface of the carrier when the carrier is properly seated on the bottles. It is therefore necessary to provide clearance in the platen for the upwardly extending closures. Otherwise, the closures would prevent the platen from moving downwardly to the end of its path of travel and proper seating of each of the container engaging means would not be insured.

Accordingly, the platen surface is provided with six recesses or openings 74, the centers of which are aligned with the vertical axis of each closure. The diameter of each of the recesses 74 in platen 42 is slightly larger than the diameter of the closure, at its widest part, which is that part which covers the annular projection or flange at the neck of the bottle. Thus, recesses 74 serve to prevent closures C from obstructing the downward path of movement of the platen, such that complete seating of the carrier is assured in every instance.

The downwardly extending platen projections cooperate with the finger-grip openings in the carrier to automatically align the carrier with respect to the platen surface, prior to contact between the platen surface and the upper surface of the carrier. The carrier is always completely properly aligned before any downward force is exerted thereon such that breakage of the closures, the carrier or the bottles due to misalignment of the carrier is eliminated. Once the carrier is properly aligned with respect to the platen, the downward movement of the platen exerts a uniform force across the top of the carrier such that the carrier is moved downwardly with respect to the bottles until the container engaging means is properly seated with respect to each bottle. The recesses in the platen prevent the upwardly protruding closures from obstructing the path of downward movement of the platen.

It will now be appreciated that the present invention relates to a carrier applicator designed for fully automatic high-speed operation which insures proper seating of the carriers in each instance. Moreover, the structure and positioning of the downwardly extending platen projections, and the manner in which same cooperate with the finger-grip openings in the carrier, insures that the carrier will be automatically properly aligned with respect to the platen and containers during the application operation. Thus, both alignment and seating occur in a single, simple operation.

While only a single preferred embodiment of the present invention has been disclosed herein for purposes of illustration, it is obvious that many modifications and variations could be made thereto. It is intended to cover all of these variations and modifications which fall within the scope of the present invention, as defined by the following claims.

I claim:

1. Apparatus for applying a carrier to a set of containers, the carrier being of the type having a surface with first and second spaced finger-grip openings therein and means for engaging the containers, said apparatus comprising a platen, means for supporting a set of containers with a carrier situated thereon and means for moving said platen towards said support means, said platen comprising means for engaging and cooperating with both of the fingergrip openings to align the carrier relative to the platen, means for exerting a force on the carrier in the direction of said supporting means to cause the containers to be received in the container engaging means, and menas for receiving the portions of the containers which extend above the container engaging means.

2. The apparatus of claim 1, wherein said carrier alignment means comprises first and second spaced projections extending from said platen in the direction of said support means and positioned along said platen in alignment with the desired positions of the respective finger-grip openings.

3. The apparatus of claim 2, wherein each of said projections comprises a base having a peripheral surface of substantially the same size and shape as the finger-grip openings, a tip substantially smaller than said surface of said base and an intermediate section extending between said tip and said base and comprising an inclined surface.

4. The apparatus of claim 3, wherein said inclined surface of said intermediate section engages the edge of the aligned finger-grip opening, as the platen is moved towards said support means, and moves the carrier relative to the platen in a direction parallel thereto, until said base is received in the finger-grip opening.

5. The apparatus of claim 3, wherein said tip comprises an inclined surface.

6. The apparatus of claim 5, wherein said inclined surface of said tip engages the edge of the finger-grip opening in the event of gross misalignment of the carrier.

7. The apparatus of claim 5, wherein the inclination of said inclined surface of said tip is greater than the inclination of said inclined surface of said intermediate section.

8. The apparatus of claim 1, wherein said force exerting means comprises the surface of said platen from which said projections extend.

9. The apparatus of claim 1, wherein said receiving means comprises a plurality of recesses in said platen, each of which is aligned with a different one of the container engaging means of the carrier.

10. The apparatus of claim 6, wherein said recesses are larger than the container engaging means.

11. The apparatus of claim 3, wherein said force exerting means comprises the surface of said platen from which said projections extend.

12. The apparatus of claim 11, wherein said receiving means comprises a plurality of recesses in said platen, each of which is aligned with a different one of the container engaging means of the carrier.

13. The apparatus of claim 12, wherein said recesses are larger than the container engaging means.

14. Apparatus for applying a carrier to a set of containers, the carrier comprising a surface having first and second spaced circular finger-grip openings therein of a given diameter and container engaging means, said apparatus comprising a platen, means for supporting a set of containers with a carrier situated thereon and means for moving said platen in a direction towards said support means, said platen comprising a surface facing the support means and first and second projections extending therefrom, each of said projections being located on said platen surface at points aligned with the desired positions of the respective finger openings, each of said projections having a base with a diameter substantially equal to the given diameter, a tip of a diameter substantially smaller than the given diameter and an intermediate section extending between said base and said tip and having an inclined surface, said inclined surface being effective, as the platen is moved towards the carrier, to engage the edge of the aligned finger-grip opening and to move the carrier relative to the platen surface in a direction substantially parallel thereto to a position aligned with said base and wherein further movement of said platen towards said support means causes said platen surface to engage the carrier surface and exert a force thereon in the direction of the support means, said platen surface having a plurality of recesses therein, each of which is aligned with a different one of the container engaging means on the carrier, said recesses being effective to receive therein the portions of the containers which extend above the container engaging means.

15. The apparatus of claim 14, wherein said tip comprises an inclined surface.

16. The apparatus of claim 15, wherein said inclined surface of said tip engages the edge of the finger-grip opening in the event of gross misalignment of the carrier.

17. The apparatus of claim 16, wherein the inclination of said inclined surface of said tip is greater than the inclination of said inclined surface of said intermediate section.

* * * * *